US007487706B2

(12) United States Patent
Vallebrant et al.

(10) Patent No.: US 7,487,706 B2
(45) Date of Patent: Feb. 10, 2009

(54) DEVICE FOR CONTROLLING A HYDRAULICALLY DRIVEN MOTOR

(75) Inventors: Per-Ola Vallebrant, Trollhättan (SE); Mikael Sannelius, Älvsjö (SE)

(73) Assignee: Parker-Hannifin Corporation, Cleveland, OH (US)

( * ) Notice: Subject to any disclaimer, the term of this patent is extended or adjusted under 35 U.S.C. 154(b) by 186 days.

(21) Appl. No.: 10/549,729

(22) PCT Filed: Mar. 19, 2004

(86) PCT No.: PCT/SE2004/000407

§ 371 (c)(1),
(2), (4) Date: Sep. 19, 2005

(87) PCT Pub. No.: WO2004/083652

PCT Pub. Date: Sep. 30, 2004

(65) Prior Publication Data

US 2006/0249015 A1 Nov. 9, 2006

(30) Foreign Application Priority Data

Mar. 21, 2003 (SE) ..... 0300760

(51) Int. Cl.
*F15B 13/04* (2006.01)

(52) U.S. Cl. ..... 91/418; 91/445; 91/446

(58) Field of Classification Search ..... 91/418, 91/429, 445, 446, 468, 469
See application file for complete search history.

(56) References Cited

U.S. PATENT DOCUMENTS 2,795,933 A 6/1957 McCallum
2,878,015 A * 3/1959 Panissidi ..... 226/156
2,884,902 A * 5/1959 Headings ..... 91/448
3,543,646 A * 12/1970 Iijima ..... 91/530
4,051,764 A * 10/1977 Murata ..... 91/29
4,364,827 A * 12/1982 Guttman ..... 91/459
4,722,258 A 2/1988 Johnson
6,026,730 A * 2/2000 Yoshida et al. ..... 91/447
6,041,683 A 3/2000 Timperi et al.
6,220,027 B1 * 4/2001 Heusser ..... 60/422
6,244,158 B1 * 6/2001 Roche ..... 91/446
6,986,368 B2 1/2006 Brown
7,017,460 B2 3/2006 Virvalo et al.

OTHER PUBLICATIONS

Copending U.S. Appl. No. 10/549,736, filed Sep. 19, 2005, Per-Ola Vallebrant.
Copending U.S. Appl. No. 10/549,728, filed Sep. 19, 2005, Per-Ola Vallebrant.

* cited by examiner

*Primary Examiner*—Igor Kershteyn
(74) *Attorney, Agent, or Firm*—Daniel J. Whitman

(57) ABSTRACT

The present invention relates to an arrangement for controlling a hydraulically driven motor (2), forming part of a hydraulic system in which hydraulic fluid under pressure forms a main flow through a main duct (1) in which the motor is connected. The motor is adapted to drive a load with varying loading, and one or more valves (6, 7) are adapted for controlling the hydraulic fluid flow through the motor on the one hand during operation and on the other hand for starting and stopping of the motor. One of the valves consists of a flow control valve (7) which is connected in the main duct (1) downstream of the motor (2) and is adapted for on the one hand starting/stopping of the motor and on the other hand constant flow control of the hydraulic fluid flow through the motor.

12 Claims, 2 Drawing Sheets

DEVICE FOR CONTROLLING A HYDRAULICALLY DRIVEN MOTOR

TECHNICAL FIELD

The present invention relates to an arrangement for controlling a hydraulically driven motor.

BACKGROUND OF THE INVENTION

In certain applications, hydraulic motors work under load which varies greatly over time, which has hitherto involved problems by virtue of the fact that the inertia in a conventional hydraulic system can mean that the hydraulic liquid flow is not sufficient for supplying the motor. Another critical situation with a risk of cavitation damage is when the motor is actuated into stop position.

BRIEF SUMMARY OF THE INVENTION

The object of the present invention is to eliminate the problems indicated in the introduction so that the motor can be controlled so as to perform its tasks with maximum effectiveness.

Said object is achieved by means of an arrangement according to the present invention.

DESCRIPTION OF FIGURES

The invention will be explained in greater detail below by means of an illustrative embodiment with reference to accompanying drawings, in which.

DETAILED DESCRIPTION OF THE INVENTION

Figure 1:
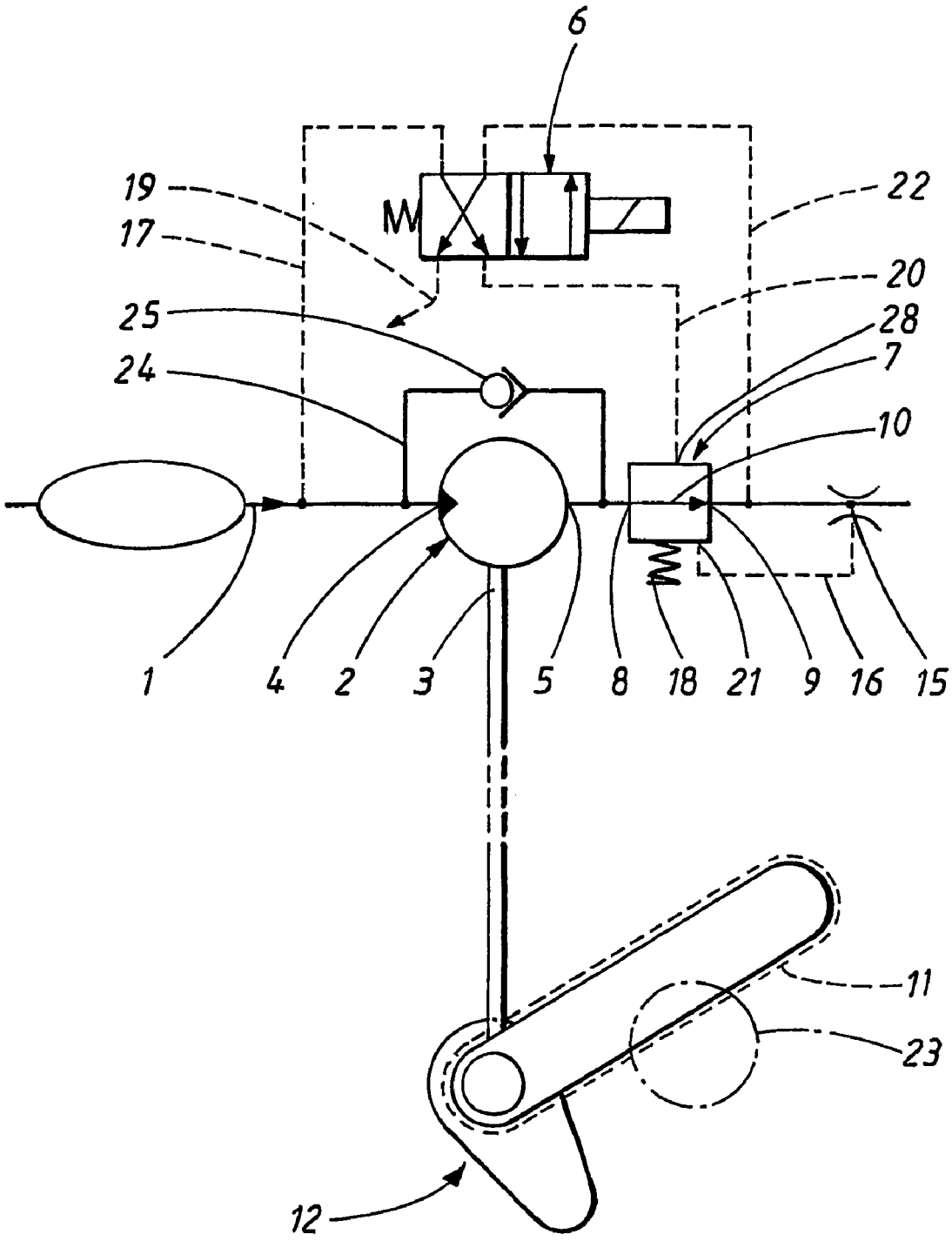
FIG. 1 shows a hydraulic system which includes an arrangement according to the invention.

A hydraulic system in which the arrangement according to the invention can be applied is accordingly shown in the example according to FIG. 1. The system includes a hydraulic fluid duct 1 for a main flow from a hydraulic fluid pump (not shown). Also present is a hydraulic fluid volume v, in which a hydraulic fluid pressure is maintained. Hydraulic fluid under pressure is the driving medium adapted to drive a hydraulic motor 2, included in the system, with an output rotation shaft 3, which is adapted to drive some form of unit which is to perform a certain task, for example a saw 11, such as a chain saw, in a harvester unit 12 for lumbering, to be precise sawing lumber. In this connection, the sawing unit and the hydraulic motor with its output rotation shaft are subjected to great instantaneous variations in load, entailing a risk of great instantaneous speed variations. Examples of types of hydraulic motor used for such applications are hydraulic axial piston machines of the bent axis type (see, for example, U.S. Pat. No. 6,336,391) or alternatively the inline type. Other types of hydraulic motor are also possible, for example a gear motor. The hydraulic motor has an inlet side 4, on which the hydraulic fluid is supplied under pressure, and an outlet side 5, from which the hydraulic fluid flows onward in the main duct 1 after pressure drop in the motor. The hydraulic system also includes a flow control valve 7, which is suitably of two-way type, with an inlet 8 and an outlet 9 and a throughflow 10 in a movable valve body, which can be adjusted between open and closed position under the action of an electrohydraulic actuator valve 6, which is adjustable between off position and on position, that is to say stop position and start/operating position, by means of an actuating device (not shown), which is actuated by an operator/computer.

The flow control valve 7 according to the invention is connected downstream of the hydraulic motor 2 on its outlet side 5 and has, in addition to the start/stop function, a constant flow function which is adapted so as, when the actuator valve 6 is in operating position and hydraulic flow passes through the flow control valve, to maintain an essentially constant hydraulic flow through the hydraulic motor 2, in principle irrespective of load variations of the motor. The throughflow of the flow control valve 7 is adapted to vary its throughflow area depending on the prevailing flow. In the example, this is sensed by sensing pressure drop across a following change in area, for example a narrowing 15, in the main duct 1 via a control duct 16 and via a control duct 22, which is connected to the main line 1 upstream of the narrowing 15, in which way the flow through the motor is controlled by means of the flow control valve depending on the pressure difference across the narrowing. The pressure-sensing upstream of the narrowing is led via the actuator valve 6. However, the narrowing can alternatively be positioned in locations in the system other than downstream of the constant flow valve, as is shown in the figure, for example upstream of the motor 2 or between the motor and the valve. Connected around the motor 2 is a shunt line 24, which includes a non-return valve 25, which is adapted for relieving pressure by being capable of opening in the event of pressure surges on the outlet side of the motor.

Figure 2:
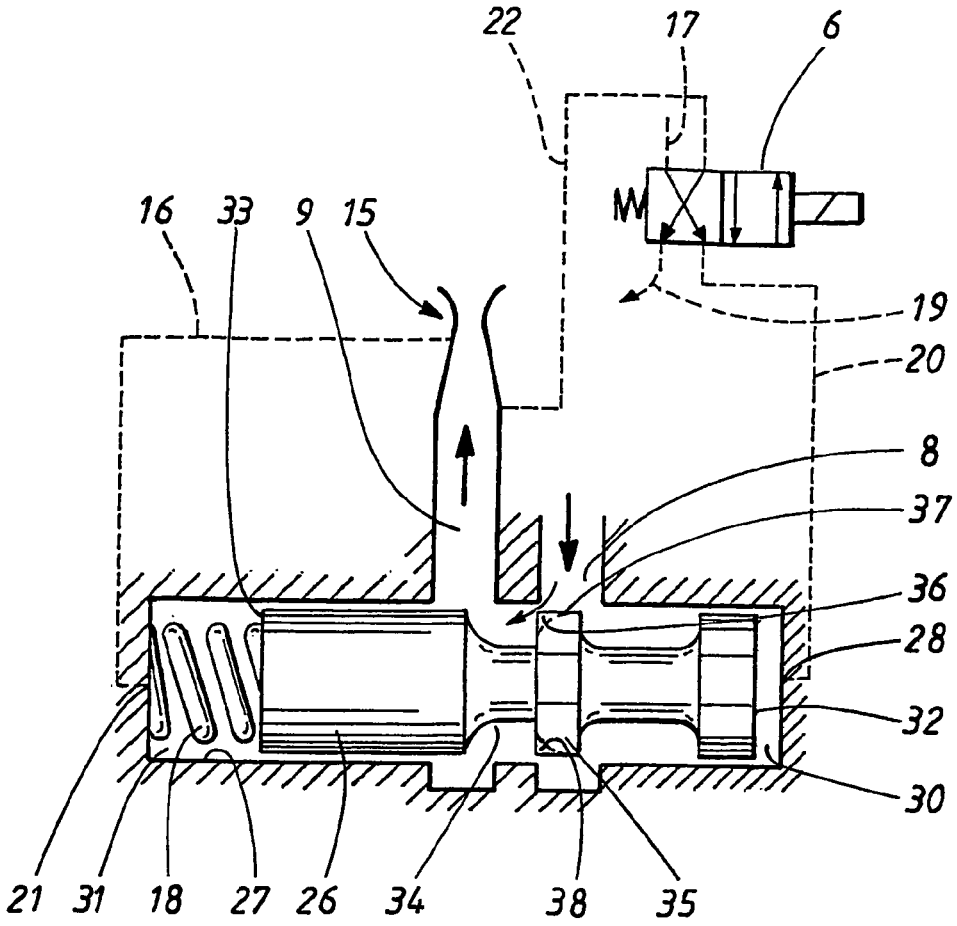
FIGS. 2-4 show an advantageous example of a flow control valve which is adapted for flow control according to the invention.
Figure 3:
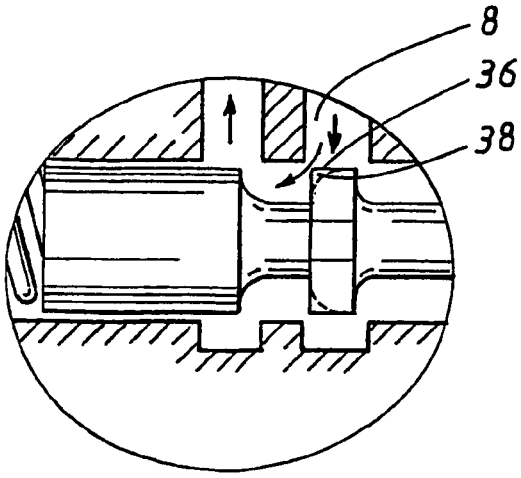
Figure 4:
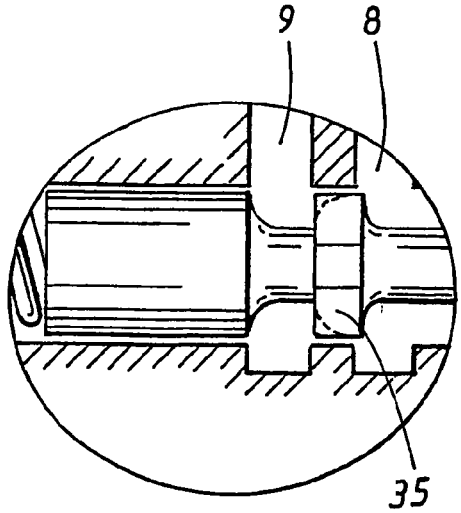

An example of an embodiment of the flow control valve 7 is shown in FIGS. 2-4. In this example, the valve body in the flow control valve 7 is embodied as a slide 26 in the form of a piston, which is movable linearly to and fro in a cylindrical bore 27 under the action of on the one hand two counteracting control pressures via the control ducts 16, 20, 22, which lead from the two sides of the narrowing 15 to their respective control input 21, 28 and on the other hand the force from the spring 18. The actuator valve 6 is connected in the same way as described with reference to FIG. 1, that is to say connected in one control duct 20, 22 between the narrowing 15, upstream thereof, and the control input 28. The control pressures act in their respective cylinder chamber part 30, 31 on the two sides of the piston/the slide 26 and create a pressing force against the respective piston surface 32, 33. The spring 18, which is suitably adjustable with regard to its spring preloading, provides the necessary additional force in order to determine at which pressure drop across the narrowing 15, and thus which speed of the motor, the slide begins to move. Arranged in the valve housing are a number of ducts for the hydraulic flows to be regulated by means of the valve. The main flow, that is to say the flow which drives the motor 2 and is to be regulated by the flow control valve 7, enters via the inlet 8 and flows out via the outlet 9. Flow regulation is effected by virtue of the throughflow 10 of the slide being formed by a passage in the form of an annular groove 34 and a bar 35 with a throttling edge 36 in the lateral wall 37 of the slide 26. By means of the axial displacement of the grooves under the action of the control pressures and the spring 18, the flow area between the inlet 8 and the outlet 9 is regulated, in which way the main flow is regulated. As indicated by dashed lines, the throttling edge 36 can be designed with throttling grooves 38, the design of which influences the control characteristic.

The functioning of the hydraulic system will now be described with reference to all the figures. The general operating requirement for the invention is that as constant an optimized speed as possible of the motor 2 and its output rotation shaft 3 is to be maintained during normal operation and that extreme, instantaneous changes in speed are to be counteracted to as great an extent as possible, in spite of instantaneous load fall-off. An example of such an application is therefore sawing through a log 23, where the risk of what is known as racing arises owing to accumulated energy in hoses etc. symbolized by v, when the log has been sawn through and the load falls off. This is achieved by the flow control valve 7 being dimensioned to work with a rapid response and by this valve being positioned downstream of the motor 2, that is to say on its outlet side 5. When the actuator valve 6 is in stop position, the flow control valve 7 is controlled so as to be closed by the action of system pressure, that is to say full fluid pressure via the control duct 17, and control pressure from the control duct 20 counter to the action of the force from the valve spring 18. In the stop position, the pump pressure acts via the control duct 20 and via one control input 28 of the control valve 7 on one side 32 of the slide, which results in the slide 26 moving into end position and shutting off the entire main flow (see FIG. 4). It can be seen from the figure that the bar 35 completely blocks communication between the inlet 8 and the outlet 9. Any load-sensing via a sensing duct 19 senses low pressure at the same time. If the pump pressure should fall, the force holding the flow control valve closed decreases. On the other hand, the force for rotating the motor decreases at the same time.

When the actuator valve 6 is adjusted from stop position to start position/acceleration position, the flow control valve 7 is opened by the spring 18 and is kept open because the control area is now acted on by the pressure in the control duct 22, which, in the start position, is the same as in the control duct 16 (see FIG. 3). It can be seen that the slide 26, by virtue of the action of the spring (compression spring), is displaced to the right in the figure in such a way that the bar 35 with its throttling edge 36 leaves the inlet open.

During operation, the flow control valve 7 works as a constant flow valve, the aim being to keep the hydraulic fluid flow through the flow control valve, and thus through the motor 2, constant by virtue of the valve being fully open when the flow is too low, and seeking to throttle the flow, that is to say brake the motor, when the flow is too high. If load-sensing is present, system pressure is sensed, which provides maximum flow. On stopping, the motor is braked on the rear side by the actuator valve 6 being adjusted to stop position again, the flow control valve 7 then being adjusted to closed position.

In the case of both constant flow control and stopping, the hydraulic fluid pressure at the motor inlet 4 is guaranteed the whole time by the system according to the invention, in contrast to known solutions with a compensator and a stop valve before the motor, where there is a risk of the motor running faster than the flow is sufficient for and thus rotating like a cavitating pump. By virtue of the start/stop function and the constant flow function being integrated in one and the same valve component, a compact construction and short fluid ducts for the main flow, especially between the valve and the motor, are made possible. For example, the valve can be integrated with the motor block, that is to say the motor housing.

The invention is not limited to the examples described above and shown in the drawings but can be varied within the scope of the patent claims below. For example, the load can be a linear motor, such as a piston cylinder. The flow control valve 7 can have a different construction; for example, the valve body can be adapted to be rotated under the action of two counteracting start flows, the throughflow passage then being designed differently.

The invention claimed is:

1. An arrangement for controlling a hydraulically driven motor (2), forming part of a hydraulic system in which hydraulic fluid under pressure forms a main flow through a main duct (1) in which the motor is connected, the motor being adapted to drive a load with varying loading, and one or more valves (6, 7) being adapted for controlling the hydraulic fluid flow through the motor during operation and also for starting and stopping of the motor, characterized in that one of the valves comprises a spool-type flow control valve (7) which is connected in the main duct (1) downstream of the motor (2) and is adapted for starting and stopping the motor and flow control providing substantially constant flow rate of the hydraulic fluid through the motor under varying loading.

2. The arrangement as claimed in claim 1, characterized in that the spool-type flow control valve (7) is adapted to control the flow through the main duct (1) depending on a sensed pressure drop across a change in area (15) which is arranged in the main duct downstream of the motor.

3. The arrangement as claimed in claim 1, characterized in that the motor (2) has an output rotation shaft (3) for driving a rotating load.

4. The arrangement as claimed in claim 1, characterized in that the load consists of a saw (11) in a sawing unit.

5. The arrangement as claimed in claim 1, characterized in that the spool-type flow control valve (7) is integrated with a motor housing.

6. An arrangement for controlling a hydraulically driven motor (2) forming part of a hydraulic system in which hydraulic fluid under pressure forms a main flow through a main duct (1) in which the motor is connected, the motor being adapted to drive a load with varying loading, and one or more valves (6, 7) being adapted for controlling the hydraulic fluid flow through the motor on the one hand during operation and on the other hand for starting and stopping of the motor, characterized in that one of the valves consists of a flow control valve (7) which is connected in the main duct (1) downstream of the motor (2) and is adapted for on the one hand starting/stopping of the motor and on the other hand constant flow control of the hydraulic fluid flow through the motor, the flow control valve (7) being adapted to control the flow through the main duct (1) depending on a sensed pressure drop across a change in area (15) which is arranged in the main duct downstream of the motor, the flow control valve (7) having two control inputs (21, 28) for controlling the flow control valve, one control input (28) being adapted to receive a control flow which can alternately be connected to the main duct (1) upstream of the flow control valve for a stop position of the valve, that is to say blocking of the main flow, or connected to a control flow for a start position of the valve, that is to say fully open main flow, or constant flow control, and the other control input (21) being adapted to receive a control flow via a control duct (22) which is connected to a location in the main duct on one side of the change in area (15).

7. The arrangement as claimed in claim 6, characterized in that the flow control valve (7) has a valve housing and a valve body (26) which is movable in the valve housing and is provided with a throughflow passage (10) which is adapted so as, under the action of the force from the two control flows and a spring (18) and thus by virtue of the motion of the valve body, to vary its area relative to the inlet (8) or the outlet (9), and in that an actuator valve (6) is adapted for said changing between control flow to one control input (28) for start position with open flow control valve, constant flow control with variable main flow depending on the pressure drop across the change in area, and stop position with fully closed flow control valve.

8. The arrangement as claimed in claim 7, characterized in that the valve body consists of a piston slide (26) which is movable to and fro in a cylindrical bore (27), into one end of which one control input (28) leads and into the opposite end of which the other control input (21) leads.

9. An arrangement comprising:

a hydraulically driven motor, the motor being adapted to drive a load with varying loading, a duct through which hydraulic fluid under pressure flows, and at least one spool-type valve adapted for controlling the hydraulic fluid flow through the motor, the at least one spool-type valve located downstream of the motor and adapted to start and stop the motor as well as provide a flow control providing substantially constant flow rate of the hydraulic fluid through the motor under varying loading.

10. The arrangement of claim 9 further including a narrowing of the duct in a location downstream of the motor, the at least one spool-type valve being responsive to a pressure drop across the narrowing to control hydraulic fluid flow through the motor.

11. The arrangement of claim 9 wherein the motor has an output rotation shaft for driving a rotating load.

12. The arrangement of claim 11 wherein the load comprises a saw in a sawing unit.

* * * * *